United States Patent [19]

Feeley et al.

[11] 4,192,513

[45] Mar. 11, 1980

[54] DIAMOND ALPHABET PLAYING CARDS

[76] Inventors: John M. Feeley; Ruth E. Feeley, both of 19333 Plummer St., Northridge, Calif. 91324

[21] Appl. No.: 898,716

[22] Filed: Apr. 24, 1978

Related U.S. Application Data

[63] Continuation of Ser. No. 722,381, Sep. 13, 1976, abandoned.

[51] Int. Cl.[2] ..... A63F 1/02

[52] U.S. Cl. ..... 273/294; 35/71; 273/299; 273/302

[58] Field of Search ..... 273/294, 299, 302, 304; 35/35 J, 70, 71

[56] References Cited

U.S. PATENT DOCUMENTS

| | | | |
|---|---|---|---|
| 1,012,574 | 12/1911 | Adams | 273/299 |
| 2,265,334 | 12/1941 | Armbruster | 273/299 X |
| 2,783,998 | 3/1957 | Collins | 273/299 |
| 3,678,602 | 7/1972 | Alam | 273/299 |
| 3,935,651 | 2/1976 | Mankoff et al. | 273/302 |

FOREIGN PATENT DOCUMENTS

| | | | |
|---|---|---|---|
| 3216 | of 1886 | United Kingdom | 273/294 |

*Primary Examiner*—Anton O. Oechsle
*Attorney, Agent, or Firm*—Cesari & McKenna

[57] ABSTRACT

Playing cards are disclosed having a unique diamond shape that facilitates the handling and display of the cards. A three-letter sequence is imprinted centrally on the front face of each card, the letters forming a natural alphabetic sequence. The second letter in the sequence is also imprinted near the upper and lower corners of each card in mutually inverted orientations so as to be readily visible and recognizable from either end of the card. The cards are divided into four suits such as diamonds, hearts, spades and clubs. Each of the cards has a corresponding suit symbol imprinted near the upper and lower corners thereof again in mutually inverted orientations so as to be recognizable from either end of the card. There are preferably twenty-six cards in each suit with each suit having cards with a second letter in the three-letter sequence corresponding to the letters of the alphabet from "A" to "Z". The cards can be used for playing word games as well as conventional card games.

17 Claims, 3 Drawing Figures

DIAMOND ALPHABET PLAYING CARDS

This is a continuation of application Ser. No. 722,381 filed Sept. 13, 1976, now abandoned.

BACKGROUND OF THE INVENTION

This invention relates to game apparatus and, more particularly, to playing cards having a unique combination of alphabet and suit designations that permits the cards to be used in playing conventional card games as well as a variety of new and interesting word games and further having an improved shape that facilitates handling and viewing of the cards.

Conventional playing cards are typically divided into four suits designated, respectively, diamonds, hearts, spades and clubs. Each suit contains thirteen cards including an "ACE", nine number cards having values from "2" to "10" and three "picture" cards, typically designated "JACK or KNAVE, QUEEN and KING". A conventional deck thus includes a total of 52 cards. Over the years, numerous games of varying degrees of amusement and complexity have been devised to be played with such conventional playing cards.

From time to time over the years, playing cards have been proposed which include alphabet letter designations imprinted on their faces. Alphabet cards have been disclosed, for example, in the following U.S. Pat. Nos. 1,012,574; 1,243,085; 1,332,249; 2,042,930; and 2,783,998. Cards of this type are typically utilized in word games in which the player's ability to spell words under various conditions and from various combinations of of the cards is tested. Word games of this type have been found to be not only entertaining but beneficial in an educational sense since they tend to improve the players' spelling ability and vocabulary.

A problem with alphabet playing cards that have been proposed heretofore has been their general lack of versatility. In many cases, the arrangement and distribution of alphabet letters on the cards have been specially selected for use in playing only one specific game. Thus, when players become bored with that game, the cards are no longer used. In other cases, the alphabet cards can be used in playing a variety of word games, but not for playing conventional games such as those typically played using conventional four-suit cards of the type described above. Thus, when players desire to play such conventional games rather than word games, the alphabet cards are set aside in favor of conventional four-suit cards.

Most playing cards available heretofore are also of a rectangular shape with the length, or height of the cards being greater than their width. The card value and suit are typically represented by an illustration located centrally on a face of the card and are also indicated in mutually inverted orientations near the upper left and bottom right end of that face. This allows each card to be viewed and its value and suit recognized from either end. However, when a player holds the cards in his hand, the cards are typically fanned by holding the lower ends of the cards together and angularly displacing the upper ends with respect to one another so that only the value and suit designations imprinted near the upper left end of each card are visible to the player. When the player lays such a fanned-out hand down on a table for display to others with whom he is playing, the value and suit designations are properly oriented and readily visible to him. Players seated around the table, however, must view the cards at an angle which may be 180° displaced from the line of sight of the player who has laid the hand down. It is thus difficult for the other players to see and evaluate the hand on the table unless it is rotated in their direction. It is, therefore, an object of this invention to provide improved playing cards.

Another object of the invention is to provide playing cards having alphabetic letter designations thereon that permit their use in playing a variety of new, interesting and educational word or alphabet games.

Another object of the invention is to provide playing cards having suit and alphabetic letter designations thereon that permit their use in playing a variety of new, interesting and educational word games as well as conventional card games.

Still another object of the invention is to provide playing cards having improved shape that permits the cards to be easily held in a player's hand and that provides improved visibility of each of the cards when the player's hand is laid down on a table.

SUMMARY OF THE INVENTION

Briefly, in accordance with this invention, a plurality of playing cards are provided, each of which includes a front and rear face and has the shape of a diamond including four sides and four corners. A three-letter sequence is imprinted centrally on the front face of each card, the letters forming a natural alphabetic sequence, such as ZAB, ABC, BCD, etc. The cards are divided into a plurality of different suits and each of the cards also has its corresponding suit represented on the front face thereof.

Preferably, the letter that each card represents is the second, or central, letter in the three-letter sequence. That letter is thus preferably imprinted on the card in considerably larger type than either of the first or third letters in the sequence. The second letter, along with the suit designations of the card, is also imprinted near the upper and lower corners of the card in mutually inverted orientations so that the letter and suit of each card can readily be viewed and recognized from either end of the card.

An illustrative embodiment of the invention includes 104 of the cards divided into four different suits (e.g., diamonds, hearts, spades and clubs). Each of the suits includes 26 cards. There are cards in each suit having a second letter in the imprinted three-letter sequence corresponding to each of the letters of the alphabet from "A" to "Z". There may also be included a plurality (e.g., 10) of "wild" cards which may be used to represent any of the 26 letters and any of the four suits.

The cards can be used in playing a wide variety of new, interesting and educational word games, one of which is described hereinbelow by way of example. The cards can also be used in playing conventional games of the type played using conventional four-suit cards. For example, the wild cards and half of the cards in each suit (e.g., the cards corresponding to the letters "N" through "Z") can be removed from the deck, leaving the conventional number (i.e., 52) of cards. The "A" cards in each suit can then be used to represent the "ACE" of that suit, the "B" through "J" cards can be used to represent the "2 through 10" of that suit and the "K, L and M" cards can be used to represent the "KNAVE, QUEEN and KING" of that suit, respectively. This allows the cards to be used in playing any game that can be played using the conventional cards.

Because of the unique diamond shape of the cards of this invention, the cards are particularly comfortable to handle. Relatively large numbers of the cards can be easily fanned in a player's hand by holding the center-area of the cards together and angularly displacing the upper and lower edges of the cards with respect to one another. The letter and suit of each card in the fanned-out hand are clearly visible at the upper and lower ends of the hand. Thus, when the hand is laid down by a player on a table, each card in the hand can easily be viewed and recognized by the players on opposite sides of the table.

BRIEF DESCRIPTION OF THE DRAWINGS

The foregoing and other objects, features and advantages of the invention will be better understood from the following detailed description taken in conjunction with the accompanying drawing in which.

DETAILED DESCRIPTION OF ILLUSTRATIVE EMBODIMENT

Figure 1:
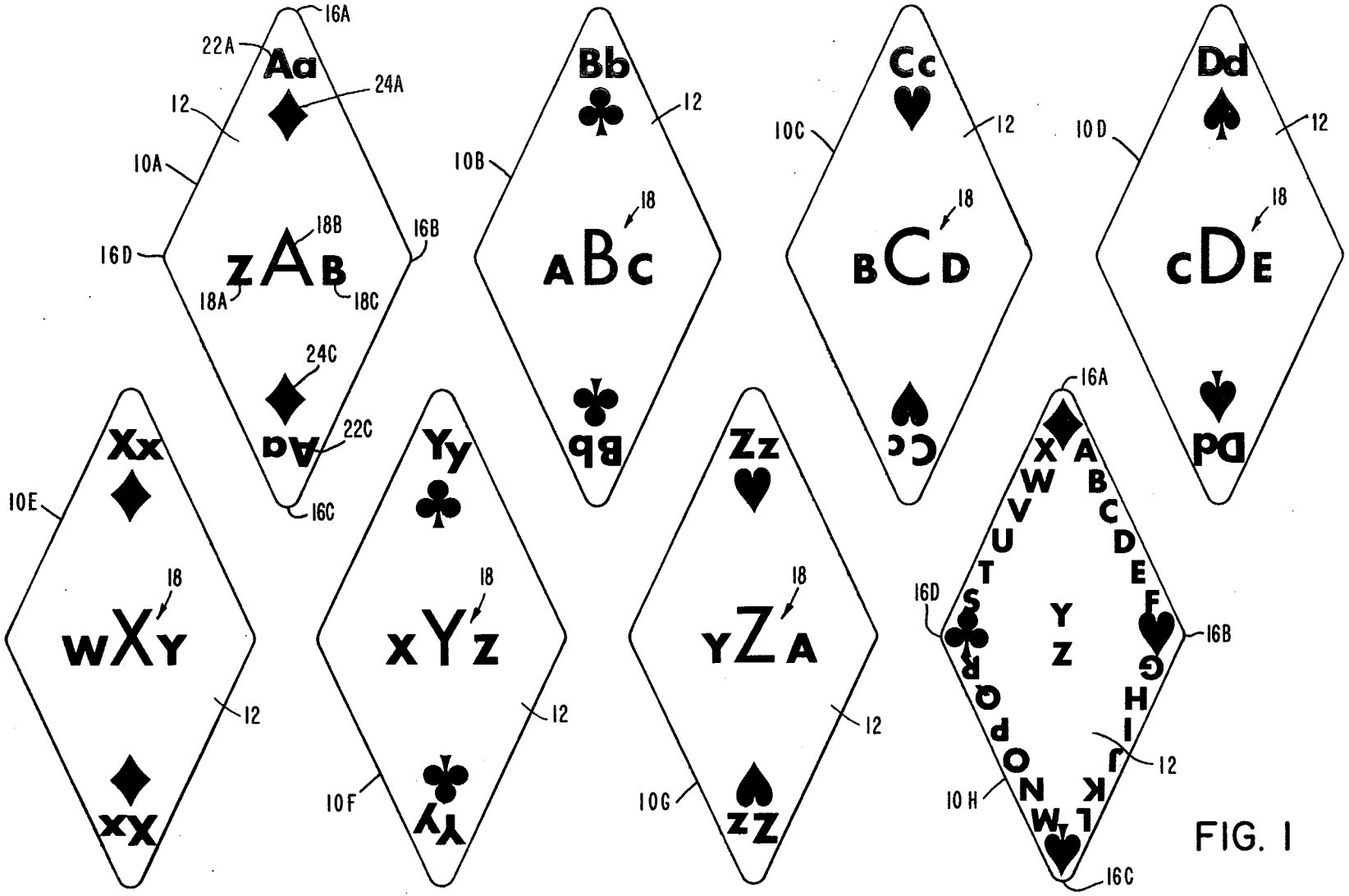
FIG. 1 illustrates the front face of several playing cards embodying the invention.

Various playing cards embodying the invention are illustrated in FIG. 1 of the drawing. The cards are hereinafter referenced generally by the numeral 10 and individually by the numerals 10A through 10H, respectively, in FIG 1.

Figure 3:
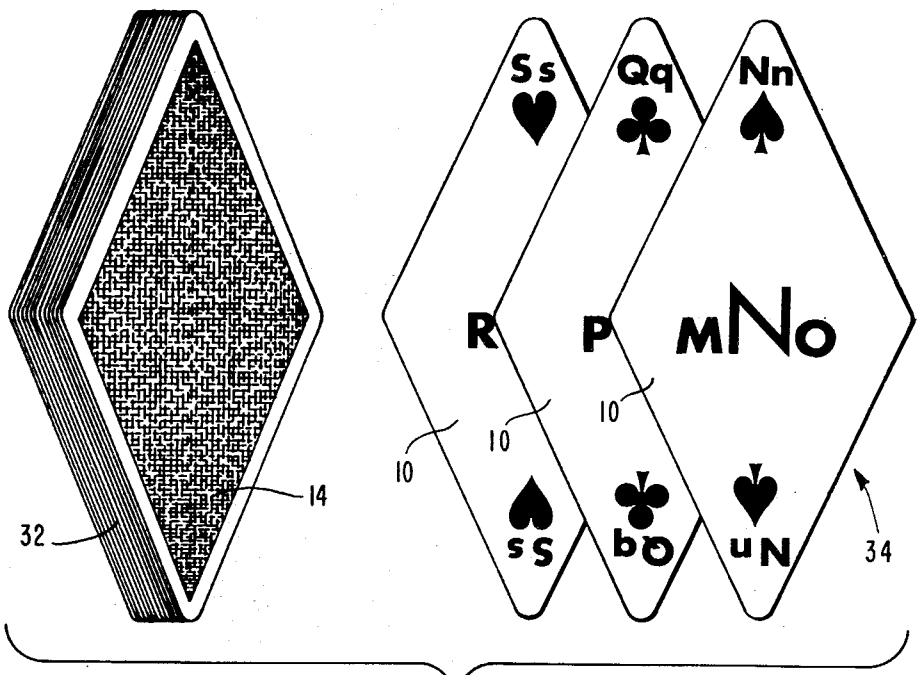
FIG. 3 illustrates the cards embodying the invention in a face-down pile from which the cards are drawn by players and in a face-up pile in which the cards are displayed to the players in a typical game.

Each card 10 includes a front face 12 which is visible in FIG. 1 and a rear face 14 which is not visible in FIG. 1 but is visible in the face-down pile 32 of cards 10 shown in FIG. 3. Each card 10 has the shape of a diamond formed by two pairs of opposed parallel sides that meet to define four, slightly rounded corners 16A, 16B, 16C and 16D, respectively. The cards 10 are preferably longer than they are wide; that is, the length of the cards 10 between the upper and lower, or vertical, corners 16A and 16C, respectively, is preferably greater than the width of the cards 10 between the left and right side, or horizontal, corners 16B and 16D, respectively. In the preferred form of the invention, the cards 10 have a length that is about twice their width. Each card 10 may be fabricated from laminated paper, relatively stiff cardboard, plastic or other suitable material from which playing cards are conventionally made.

Each card 10 has a sequence 18 of three letters imprinted at a central position on the front face 12 thereof. The letters occupying positions 18A, 18B and 18C in the sequence 18 are in a natural alphabetic order with the last letter in the alphabet being followed by the first letter in the alphabet. For example, the card 10A in FIG. 1 bears the letter sequence "ZAB"; the card 10B bears the letter sequence "ABC"; and, the card 10G bears the letter sequence "YZA". The letter that each card 10 primarily represents is the letter at position 18B in the sequence 18. The letter at position 18B is thus preferably printed on the card 10 in considerably larger type than either of the preceding and following letters at positions 18A and 18C.

The letter at position 18B is also imprinted near each of the vertical corners 16A and 16C of the card 10 at position 22A and 22C, respectively, in FIG. 1. The letters at positions 22A and 22C are imprinted in mutually inverted orientations in which the top of each letter is directed toward its associated corner of the card 10 and the bottom of each letter is directed toward the center of the card 10. This permits the letters to be easily viewed and recognized from either end of the card 10. Additionally, as indicated in FIG. 1, the letters at positions 22A and 22C may be printed in both upper and lower case format.

Each card 10 also bears a suit designation on its front face 12. Conventional suits of diamonds, hearts, spades and clubs may, for example, be employed. Conventional suit symbols are imprinted near each of the vertical corners 16A and 16C of the card 10 as indicated at positions 24A and 24C respectively, in FIG. 1. The suit symbols are also imprinted in mutually inverted orientations so that they are easily viewed and recognized from either end of the card 10. In accordance with conventional practices, the diamond and heart cards 10 may be printed with red colored ink, while the club and spade cards may be printed with black colored ink to further facilitate distinguishing the cards.

The card 10H in FIG. 1 is an example of a "wild" card embodying the invention. As indicated, the card 10H does not have the letter sequence 18 or other elements appearing on the cards 10A through 10G. Rather, the entire alphabet from "A" to "Z" is illustratively imprinted along the periphery and near the center of the card 10H. Also, each of the four conventional suit symbols are imprinted near the respective corners 16A through 16D of the card 10H. The card 10H is "wild" in that it is used by a player to represent any letter within the sequence 18 or any of the four suits appearing on the other cards 10.

The rear face 14 of each of the cards 10 is preferably imprinted with an identical design and color ink. The cards 10 are thus indistinguishable from one another when viewed from the rear.

The cards 10, because of their unique diamond shape, have been found to be particularly comfortable to handle. When holding a stack consisting of many of the cards 10, the fingers of one's hand tend naturally to straddle the aligned corners 16A through 16D of the cards. The corners 16A–16D also provide convenient points for grasping the cards 10 when separating individual cards from the stack or mixing (e.g., shuffling) the cards in the stack.

Figure 2:
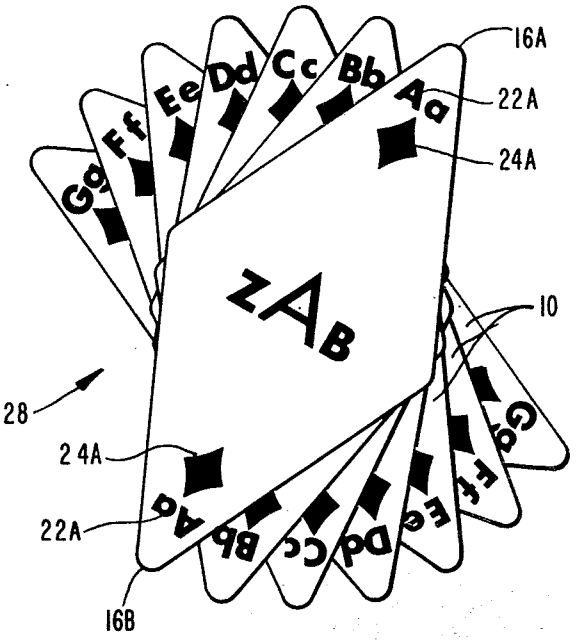
FIG. 2 illustrates several playing cards embodying the invention which have been fanned for holding in a player's hand or for displaying to other players in a game.

Also, because of the unique diamond shape, relatively large numbers of the cards 10 can easily be fanned-out in a player's hand so that the letter and suit of each of the cards are readily visible. Such a fanned-out group 28 of the cards 10 is illustrated in FIG. 2 of the drawings. The cards 10 in the group 28 are held by pressing them together near their centers while the upper and lower corners 16A and 16C of the cards 10 are angularly displaced from one another until the letters and suit symbols in the positions 22A, 22C, 24A and 24C on each card 10 are visible. When the group 28 is to be displayed to others, as is required in many conventional card games, it can be displayed or laid on a table in the fanned-out condition illustrated in FIG. 2. All cards 10 in the group 28 are clearly visible and easily recognizable from opposite sides of the table. This contrasts with conventional rectangularly shaped playing cards of the type described above which, when fanned-out, are difficult to read from opposite sides of the table without physically turning them toward each viewer.

Many conventional card games also require that cards be picked from a face-down pile such as the face-down pile 32 of the cards 10 shown in FIG. 3, and then discarded face-up in a pile so that each discarded card is visible to the various players. The conventional rectangularly shaped cards can not be displayed face-up and made equally visible from opposite sides of a table unless the entire face of each card is uncovered. However, the diamond shaped cards 10 of this invention can be displayed face-up as illustrated in the pile 34 in FIG. 3 so that the cards 10 overlap significantly and the letters and suit symbols thereon are still equally visible from opposite sides of the table.

In a specific illustrative embodiment of the invention, a deck includes 104 of the cards 10 divided into the four suits of diamonds, hearts, spades and clubs. Each of the suits is made up of cards of the type represented by the cards 10A–10G in FIG. 1. There are cards in each of the four suits having a second letter in the three-letter sequence 18 corresponding to each of the letters of the alphabet from "A" to "Z", making a total of twenty-six cards in each suit. There are also included ten "wild" cards of the type represented by the card 10H in FIG. 1. Each of the cards 10 in the deck has a length of about 4¼ inches and a width of about 2⅛ inches.

The above-described deck of the cards 10 can be used in playing a wide variety of new and interesting word or alphabet games which we have devised that are not only entertaining but also test a player's spelling ability, vocabulary, familiarity with the alphabet and quickness of thought. One such word game which we have devised to be played with the cards 10 is "Baseball Diamond Poker", the basic rules of which are described below.

"Baseball Diamond Poker" may be played by two, three or four players. Each of the 104 suit cards 10 are used as well as eight of the wild cards 10H. The cards 10 are shuffled and each player is dealt nine of the cards. The remaining cards are placed face-down in a pile near the center of the table.

The object of the game is to make complete words and melds (i.e., combinations of cards of the same suit in natural alphabetic sequence) from the cards each player holds and to advance around the bases of a baseball diamond in an effort to score runs. The player with the most runs at the end of the game is the winner. The more letters in the word made or the more complex the meld made, the greater value in terms of the number of bases that is awarded to each word or meld.

Eacy player takes one turn in each inning for a total of nine innings. The first player tries to make words or melds from the nine cards in his hand. Each time a word or meld is made, the player places a "man" on base and advances any other "men" he may have on base before that "man". The player also replenishes his hand to nine cards each time a word or meld is made. When the player can no longer make a word or meld, the inning ends for that player and it becomes the next player's turn "at bat".

If any player cannot make a word or meld from the cards he holds, then he may discard three of his cards in a face-down pile in front of him and take three new cards from the pile in the center of the table. This, however, gives the player a STRIKE and forces him to forfeit his turn. When any one player accumulates three such STRIKES in the course of the game, he can no longer play and must rely upon the runs, if any, he has scored up to that point. A timer (e.g., one minute) can be used to force each player to make a play within a pre-set time limit or to forfeit his turn.

The following system of scoring is used:

1. SINGLE (one base)
   a. three of any one letter (e.g., C—C—C),
   b. a three-letter word (e.g., C—A—T),
   c. a three-card meld (e.g., C—D—E of the same suit),
   no "wild" cards 10H can be used in forming the above three-card combinations;
2. DOUBLE (two bases)
   a. a four-letter word with not all cards in the same suit,
   b. four of any one letter using one "wild" card 10H;
3. TRIPLE (three bases)
   a. a four-card meld, all of the same suit without a "wild" card 10H,
   b. a four-letter word, all of the same suit without a "wild" card,
   c. a five-card meld with not all cards of the same suit,
   d. a five-letter word with not all cards of the same suit,
   e. four of any one letter without a "wild" card 10H;
4. HOME-RUN (four bases)
   a. a five or more letter meld all of which are of the same suit,
   b. a six or more letter word with not all cards of the same suit and with no "wild" card 10H,
   c. a six or more card meld with not all cards of the same suit and with no "wild" card 10H;
5. WILD-PITCH (player can advance each of his "men" on base by one base)
   a. by laying down a "wild" card individually, thus forfeiting future use of that "wild" card;
6. STOLEN BASE
   a. by "stealing" a word which an opponent has made and adding letters thereto to form a new word, value of new word is given to player who steals;
7. SACRIFICE
   a. when a player takes a STRIKE to try for a better hand even though he can play a word or meld.

Obviously, the above rules can be modified and other rules can be added to the game to further increase its complexity.

The above-described deck of cards 10 can also be used in playing any game that is played using conventional four-suit playing cards. It will be noted that the deck, without the ten "wild" cards 10H, is, in effect, two decks of conventional four-suit playing cards. It is thus possible to remove from the deck half of the cards 10 in each suit and to use the remaining cards 10 conventionally. For example, the cards 10 corresponding to the letters "N" through "Z" in each suit can be removed and set aside. The "A" cards in each suit can then be used to represent the "ACE" of the suits, the "B through J" cards can be used to represent the "2 through 10" of the suits and the "K, L and M" cards can be used to represent the "KNAVE, QUEEN and KING" respectively, of the suits. Alternatively, the "A" cards can be used to represent the "ACE" of the suits, the "B through I" cards can be used to represent the "2 through 9" of the suits, and the "O, J, Q and K" cards can be used to represent the "10, JACK, QUEEN and KING", respectively, of the suits. Other correlations with conventional card values are possible. There is thus no need to set the cards 10 aside when conventional type games are to be played.

In summary, therefore, we have described playing cards which possess several advantages over playing cards available heretofore. The playing cards of our invention bear both letter and suit designations which are uniquely distributed among the cards. The cards can be used in playing various challenging word games as well as conventional card games. Because of the unique diamond shape and arrangement and orientation of symbols on the cards, the cards, even in groups, are easily viewed and recognized from various angles. The unique diamond shape also makes the cards comfortable and easy to handle.

It should be understood that the above-described embodiments of our invention are illustrative only and that various modifications can be made thereto without departing from the scope as defined by the appended claims. For example, suit symbols other than the conventional diamond, heart, spade and club symbols illustrated in the drawing may be employed on the cards. Actually, any suit symbols that serve to distinguish respective subsets of the cards from one another may be used. Each card may carry conventional number designations such as "2" through "10" and conventional card value symbols such as "ACE, KNAVE, QUEEN, KING" in addition to the designations described above. Instead of three-letter sequence imprinted on each card, a single letter may be used. The three-letter sequence is, however, desirable since it tends to improve the players' knowledge of the alphabet and ability to locate individual letters therein and also since it is useful in some of the games we have devised. Various different styles of writing may be used for the letters on the cards. Additionally, the specific number of suits and specific number of the cards 10 in each suit may vary. The above-described embodiment is preferred because the conventional suit symbols utilized therein are familiar to most card players and the specified numbers of cards provides versatility for playing a wide variety of games.

What we claim as new and desire to secure by Letters Patent of the United States is:

1. Game apparatus comprising a deck including a plurality of playing cards, each of said cards in said deck having a first and a second face, each of said cards in said deck having the shape of a diamond including four sides and four corners, each of said cards in said deck further having imprinted on the first face thereof a designation of its value relative to the remaining cards in said deck, said value designation being in the form of a sequence of at least three letters imprinted at a central position on the first face thereof, the letters forming a natural alphabetic sequence, the second letter in said three-letter sequence on the first face of said cards being of larger size than each of the first and third letters in said sequence.

2. Game apparatus as recited in claim 1 in which the second letter in said sequence is also imprinted near each of two opposed corners on the first face of said cards in mutually inverted orientations.

3. Game apparatus as recited in claim 2 in which the second letter in said sequence is imprinted near each of the opposed corners in both upper and lower case format.

4. Game apparatus as recited in claim 1 in which each of said cards includes first and second vertical corners and first and second horizontal corners and in which the length of each of said cards between its vertical corners is greater than the width of each of said cards between its horizontal corners.

5. Game apparatus as recited in claim 4 in which the length of each of said cards is about twice as great as the width of each of said cards.

6. Game apparatus as recited in claim 1 in which said cards are divided into a plurality of different suits, each of said cards further having imprinted on the first face thereof a designation of its corresponding suit.

7. Game apparatus as recited in claim 6 in which the suit designation of said cards is imprinted near each of two opposed corners of the first face of said cards in mutually inverted orientations.

8. Game apparatus as recited in claim 6 in which said cards are divided into four different suits designated, respectively, diamonds, hearts, spades and clubs.

9. Game apparatus as recited in claim 8 in which each of said suits includes at least twenty-six of said cards and in which the second letters in said sequences on said cards in each of said twenty-six cards in each suit correspond to the letters of the alphabet from "A" to "Z".

10. Game apparatus as recited in claim 9 further including a plurality of wild cards which represent any of the three-letter sequences or letter within said sequence or any of the suits imprinted on said other cards.

11. Game apparatus as recited in claim 6 in which each of said cards includes first and second vertical corners and first and second horizontal corners and in which the second letter in said three-letter sequence and the suit designation of each of said cards are imprinted near each of the vertical corners of the first face thereof in mutually inverted orientations.

12. Game apparatus comprising a deck including a plurality of playing cards, each of said cards having first and second faces, each of said cards having imprinted on the first face thereof a designation of its value relative to the remaining cards in said deck, said value designation comprising a sequence of three letters imprinted centrally on the first face of each of said cards, the letters forming a natural alphabetic sequence, said cards being divided into four suits, a designation of the suit of each of said cards also being imprinted on the first face of said cards, each of said suits including twenty-six cards, the second letters in said sequences on said cards in each of said twenty-six card suits corresponding to the letters of the alphabet from "A" to "Z".

13. Game apparatus as recited in claim 12 in which said suit designations on each of said cards are imprinted near the two edges of the first face of said cards in mutually inverted orientations.

14. Game apparatus as recited in claim 12 in which the second letter in said three-letter sequence on the first face of said cards is of larger size than each of the first and third letters in said sequence.

15. Game apparatus as recited in claim 12 in which the second letter in said sequence is also imprinted near the two edges of the first face of said cards in mutually inverted orientations.

16. Game apparatus as recited in claim 12 in which said four suits are designated diamonds, hearts, spades and clubs, respectively.

17. Game apparatus as recited in claim 12 further including a plurality of wild cards which represent any of the three-letter sequences or letter within said sequences or any of the suits imprinted on said other cards.

* * * * *